US008832875B2

(12) United States Patent
Odashima et al.

(10) Patent No.: US 8,832,875 B2
(45) Date of Patent: Sep. 16, 2014

(54) TRANSFER ASSIST APPARATUS, AND CONTROL METHOD THEREFOR

(75) Inventors: Tadashi Odashima, Owariasahi (JP); Takuma Nakamura, Nissin (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 809 days.

(21) Appl. No.: 12/642,165

(22) Filed: Dec. 18, 2009

(65) Prior Publication Data

US 2010/0154117 A1 Jun. 24, 2010

(30) Foreign Application Priority Data

Dec. 22, 2008 (JP) ..... 2008-325379

(51) Int. Cl.
*A61G 7/10* (2006.01)

(52) U.S. Cl.
CPC ..... *A61G 7/1017* (2013.01); *A61G 7/1065* (2013.01); *A61G 7/1086* (2013.01); *A61G 7/1059* (2013.01); *A61G 7/1048* (2013.01); *A61G 2200/52* (2013.01)
USPC ..... 5/87.1; 5/81.1 R; 5/83.1

(58) Field of Classification Search
CPC ..... A61G 7/1046; A61G 2200/32; A61G 2200/34; A61G 7/1019; A61G 7/1051; A61G 7/1017; A61G 2200/36; A61G 7/1067; A61G 7/10; A61G 7/018; A61G 2203/12; A61H 3/008; A61H 2003/043; A61B 5/0555; A61B 2019/2276; A61B 6/0457
USPC ..... 5/81.1 R, 83.1, 87.1, 86.1, 89.1
See application file for complete search history.

(56) References Cited

U.S. PATENT DOCUMENTS

| | | | | | |
|---|---|---|---|---|---|
| 3,694,829 | A * | 10/1972 | Bakker | ..... | 5/87.1 |
| 3,996,632 | A * | 12/1976 | Bakker nee Viel | ..... | 5/83.1 |
| 5,001,789 | A * | 3/1991 | Schoenberger | ..... | 5/87.1 |
| 5,367,721 | A | 11/1994 | Boyles | | |
| 5,379,468 | A | 1/1995 | Cassidy et al. | | |
| 5,737,500 | A * | 4/1998 | Seraji et al. | ..... | 700/251 |

(Continued)

FOREIGN PATENT DOCUMENTS

| | | | | |
|---|---|---|---|---|
| CN | 1792353 A | 6/2006 | | |
| EP | 304538 A2 * | 3/1989 | ..... | A61H 3/00 |

(Continued)

OTHER PUBLICATIONS

Office Action issued for U.S. Appl. No. 13/145,692 on Aug. 13, 2012.

(Continued)

*Primary Examiner* — William Kelleher
*Assistant Examiner* — Richard G Davis
(74) *Attorney, Agent, or Firm* — Kenyon & Kenyon LLP

(57) ABSTRACT

A transfer assist apparatus includes: an arm portion that has a first joint and a second joint; a holder portion linked to the arm portion; a manipulation handle for manipulating the position and the posture of the holder portion; a first drive mechanism that drives the first joint; a second drive mechanism that drives the second joint; and a control portion that controls the first drive mechanism and the second drive mechanism so that the posture of the holder portion is maintained in a predetermined acceptable range, based on information that is input from the manipulation handle, and angle information regarding the first joint and the second joint.

10 Claims, 7 Drawing Sheets

(56) References Cited

U.S. PATENT DOCUMENTS

| | | | | |
|---|---|---|---|---|
| 5,968,104 | A * | 10/1999 | Egawa et al. | 701/50 |
| 6,246,939 | B1 * | 6/2001 | Nozawa | 701/50 |
| 6,684,129 | B2 * | 1/2004 | Salisbury et al. | 700/245 |
| 6,857,778 | B2 * | 2/2005 | Mun et al. | 378/206 |
| 7,079,931 | B2 * | 7/2006 | Sahm et al. | 701/50 |
| 7,392,554 | B1 * | 7/2008 | Su et al. | 5/86.1 |
| 7,729,832 | B2 * | 6/2010 | Benckert et al. | 701/49 |
| 7,827,630 | B2 | 11/2010 | Bostelman et al. | |
| 8,527,158 | B2 * | 9/2013 | Faivre et al. | 701/50 |
| 2003/0208844 | A1 | 11/2003 | Moffa et al. | |
| 2005/0217024 | A1 | 10/2005 | Aarestad | |
| 2005/0278099 | A1 * | 12/2005 | Benckert et al. | 701/50 |
| 2006/0137577 | A1 | 6/2006 | Chang et al. | |
| 2008/0301872 | A1 * | 12/2008 | Fahrig et al. | 5/81.1 R |
| 2009/0165204 | A1 * | 7/2009 | Biersteker et al. | 5/87.1 |
| 2009/0276955 | A1 | 11/2009 | Palay et al. | |
| 2009/0293322 | A1 * | 12/2009 | Faivre et al. | 37/348 |
| 2010/0064431 | A1 | 3/2010 | Kawakami et al. | |
| 2010/0154117 | A1 | 6/2010 | Odashima et al. | |

FOREIGN PATENT DOCUMENTS

| | | | | |
|---|---|---|---|---|
| JP | 05021938 | U | 3/1993 | |
| JP | 6279058 | A | 10/1994 | |
| JP | 6287154 | A | 11/1994 | |
| JP | 07016269 | A | 1/1995 | |
| JP | 08191865 | A | 7/1996 | |
| JP | 09276335 | A | 10/1997 | |
| JP | 10295744 | A | 11/1998 | |
| JP | 2000084012 | A | 3/2000 | |
| JP | 2001104409 | A | 4/2001 | |
| JP | 2002065762 | A | 5/2002 | |
| JP | 2005237871 | A | 2/2004 | |
| JP | 2006305092 | A | 9/2006 | |
| JP | 2008-073501 | A | 4/2008 | |
| WO | 2004100100 | A1 | 11/2004 | |
| WO | 2008117538 | A1 | 10/2008 | |
| WO | WO 2008129847 | A1 * | 10/2008 | A61G 7/10 |

OTHER PUBLICATIONS

Office Action issued for U.S. Appl. No. 13/145,692 on Jan. 11, 2013.

Partial Translation of Notification of Reasons for Refusal of JP Application No. 2008-325379.

Advisory Action mailed Apr. 24, 2013 in co-pending U.S. Appl. No. 13/145,692 (2 pages).

* cited by examiner

TRANSFER ASSIST APPARATUS, AND CONTROL METHOD THEREFOR

INCORPORATION BY REFERENCE

The disclosure of Japanese Patent Application No. 2008-325379 filed on Dec. 22, 2008, including the specification, drawings and abstract is incorporated herein by reference in its entirety.

BACKGROUND OF THE INVENTION

1. Field of Invention

The invention relates to a transfer assist apparatus and a control method for the transfer assist apparatus. In particular, the invention relates to a transfer assist apparatus that has an arm structure, and a control method for the transfer assist apparatus.

2. Description of Related Art

For a care recipient who has difficulty in walking without a help, it is not easy to carry out the movement of a transfer, such as a transfer from a bed to a wheelchair, or the like, by him/herself without a help. Therefore, such a care recipient usually needs a help from a care giver. However, the helping in the transfer involves a considerable physical burden on the care giver, and places a considerable mental burden on the care recipient as well. Therefore, in recent years, many transfer assist apparatuses that assist a person having difficulty in self-helped walking in the transfer motion have been developed.

Japanese Patent Application Publication No. 2008-073501 (JP-A-2008-073501) discloses a transfer assist apparatus which has an arm structure that includes a plurality of links (joints), and in which a distal end portion of the arm structure is provided with a holder device for holding a care recipient. Usually, such a transfer assist apparatus is able to freely control the posture of the holder device by controlling the angles of the joints, and the like.

However, if the degree of freedom in the control of the posture of the holder device increases, there occurs a possibility that the posture of the holder device may become a posture that causes the care-receiving person to have a pain, due to the care giver making an error in operating the transfer assist apparatus. On the other hand, if a care giver operates the apparatus very carefully in order to avoid the foregoing problem, there arises a possibility of the operation taking a considerable amount of time.

SUMMARY OF THE INVENTION

The invention provides a transfer assist apparatus that is capable of quickly and accurately controlling the posture of a holder device, and a control method for the transfer assist apparatus.

A first aspect of the invention relates to a transfer assist apparatus. This transfer assist apparatus includes: an arm portion that has a first joint and a second joint; a holder portion linked to the arm portion; a manipulation handle for manipulating position and posture of the holder portion; a first drive mechanism that drives the first joint; a second drive mechanism that drives the second joint; and a control portion that controls the first drive mechanism and the second drive mechanism so that the posture of the holder portion is maintained in a predetermined acceptable range, based on information that is input from the manipulation handle, and angle information regarding the first joint and the second joint.

A second aspect of the invention relates to a control method for a transfer assist apparatus. The transfer assist apparatus includes an arm portion that has a first joint and a second joint, a holder portion linked to the arm portion, a manipulation handle for manipulating position and posture of the holder portion, a first drive mechanism that drives the first joint, and a second drive mechanism that drives the second joint. The control method for the transfer assist apparatus includes: detecting angle information regarding the first joint and the second joint; detecting information that is input from the manipulation handle; and controlling the first drive mechanism and the second drive mechanism so that the posture of the holder portion is maintained in a predetermined acceptable range based on the information input from the manipulation handle, and the angle information regarding the first joint and the second joint.

According to the transfer assist apparatus and the transfer assist apparatus control method in accordance with the foregoing aspects of the invention, it is possible to provide a transfer assist apparatus capable of quickly and accurately controlling the posture of the holder device, and a control method for the transfer assist apparatus.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF EMBODIMENTS

Hereinafter, concrete embodiments to which the invention is applied will be described in detail with reference to the drawings. It is to be noted, however, that the invention is not limited to the embodiments described below. Besides, for the sake of clear description, the following descriptions and the drawings are simplified as appropriate.

Figure 1:
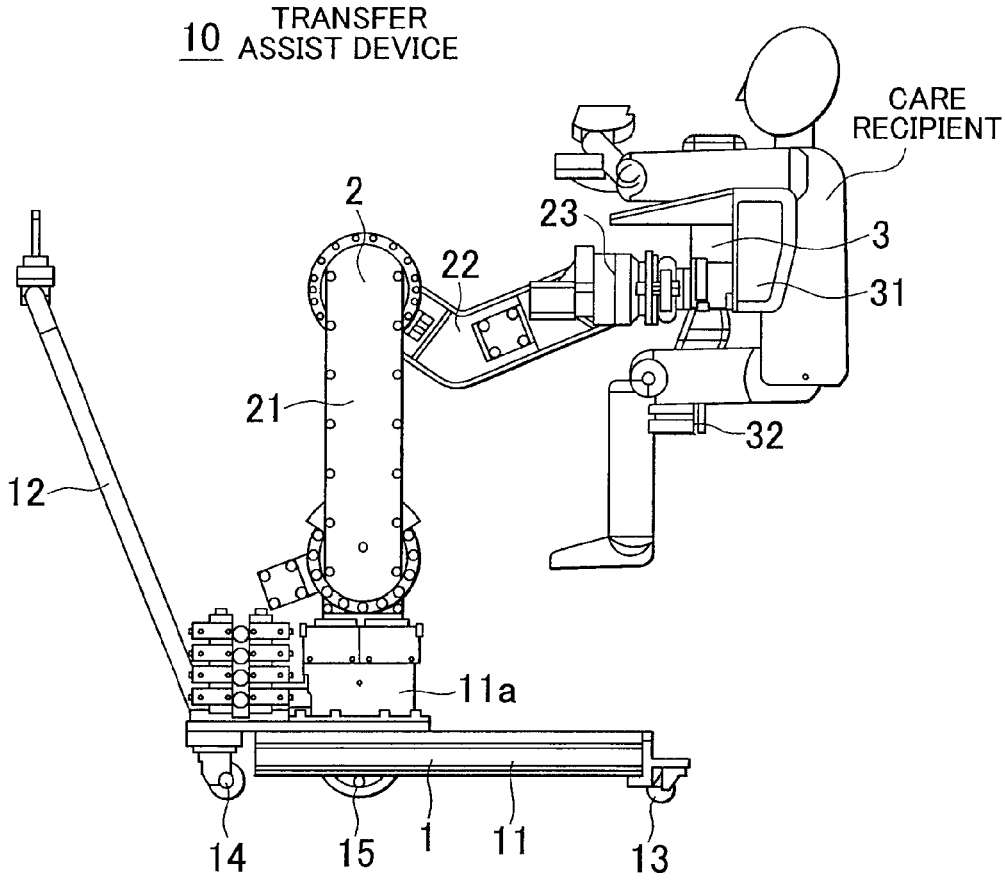
FIG. 1 is a side view showing a general construction of a transfer assist apparatus in accordance with Embodiment 1.

FIG. 1 is a diagram showing a general construction of a transfer assist apparatus in accordance with Embodiment 1 of the invention. The diagram shows an example of a state in which a care recipient is held by a holder device. As shown in FIG. 1, a transfer assist apparatus 10 in accordance with Embodiment 1 includes a carriage portion 1, a robot arm portion 2 linked to the carriage portion 1, and a holder device 3 attached to the robot arm portion 2. By operating this transfer assist apparatus 10, for example, a care giver can easily transfer a care recipient between a bed and a wheelchair, or can carry a care recipient to a toilet, an examination couch, etc., and can transfer the care recipient thereto. In this manner, the burden on the care giver at the time of transferring a care recipient can be lightened.

As shown in FIG. 1, the carriage portion 1 has a carriage body 11, a handle portion 12 provided for pushing the carriage portion 1 to move a pair of left and right front auxiliary wheels 13 that are attached to a forward portion of the carriage body 11, a pair of left and right rear auxiliary wheels 14 attached to a rearward portion of the carriage body 11, and a pair of left and right driving wheels 15 that are attached to a substantially central portion of the carriage body 11, and that drives the carriage portion 1.

The front auxiliary wheels 13 and the rear auxiliary wheels 14 are turnably attached to the carriage body 11 so that the carriage body 11 can be turned in direction. Incidentally, although the carriage body 11 is provided with two front auxiliary wheels 13, and two rear auxiliary wheels 14 in the foregoing example, the number of auxiliary wheels provided on the carriage body 11 is arbitrary.

Although not shown in FIG. 1, the left and right driving wheels 15 are linked to left and right fifth motors (fifth drive portions) 16 that drive the left and right driving wheels 15, respectively. The two fifth motors 16 can respectively rotationally drive the left and right driving wheels 15 independently of each other. Therefore, the fifth motors 16 are able to turn the carriage portion 1 to an arbitrary direction by creating a rotation difference between the left and right driving wheels 15, and are also able to move the carriage portion 1 forward and backward by powering in a forward rotation direction or a backward rotation direction. In this manner, the transfer assist apparatus 10 can be moved to an arbitrary position by causing the transfer assist apparatus 10 to travel forward or backward, or turn.

Figure 2:
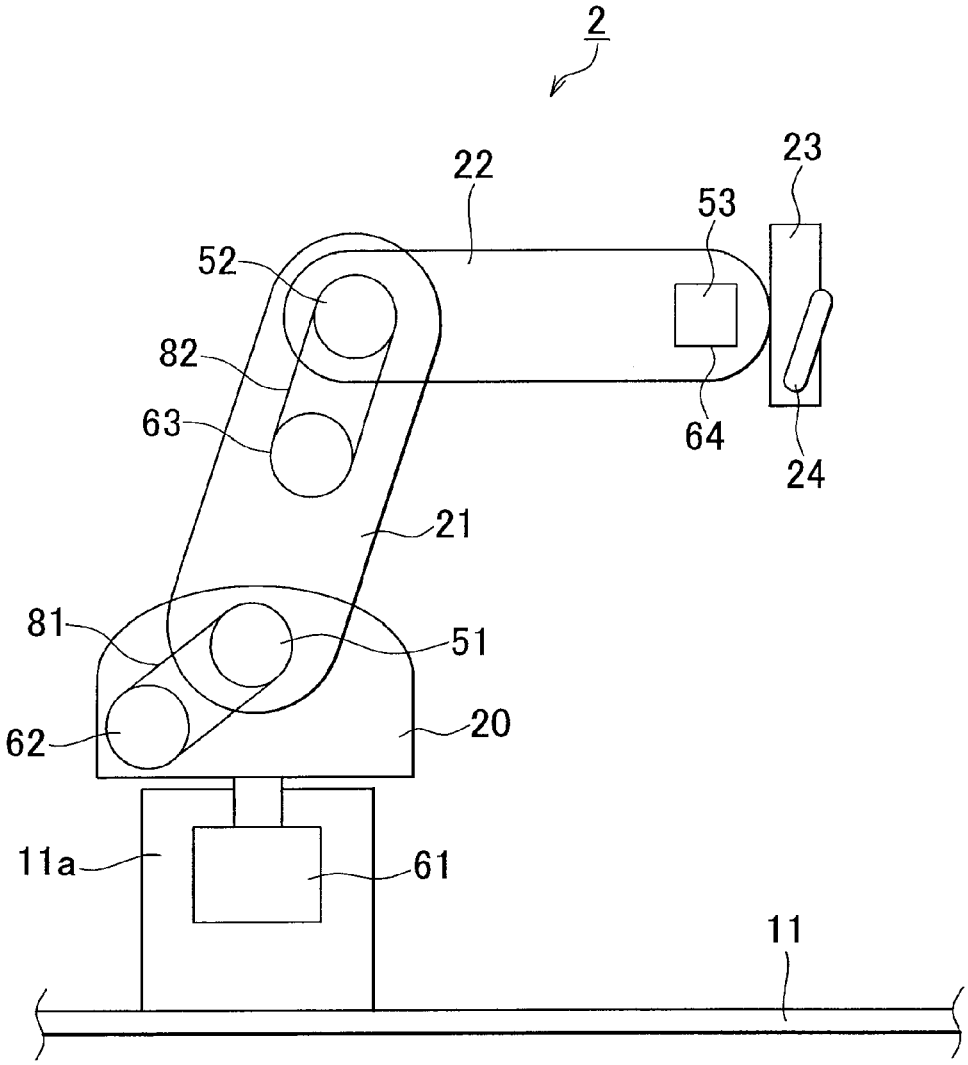
FIG. 2 is a schematic diagram showing an example of an arm portion of the transfer assist apparatus in accordance with Embodiment 1.

FIG. 2 is a schematic diagram showing an example of an arm portion 2. The arm portion 2 is a multi-joint arm that has a link root junction portion 20, a first link 21, a second link 22, and an attachment portion 23. The link root junction portion 20 is linked to a base portion 11*a* of the carriage body 11 so that rotation about a yaw axis becomes possible. The first link 21 is linked to the link root junction portion 20 via a first joint portion 51 so as to be rotatable about the pitch axis. The second link 22 is linked to the first link 21 via a second joint portion 52 so as to be rotatable about a pitch axis. Another end of the second link 22 is linked to an attachment portion 23 provided for attaching the holder device 3, via a third joint portion 53 so that the attachment portion 23 is rotatable about a roll axis.

The attachment portion 23 has a well-known mounting structure (e.g., a fastening structure using bolts and nuts, a fitting structure, etc.) that allows the holder device 3 to be attached and detached. Due to the mounting structure of the attachment portion 23, the care giver can easily attach, or detach or change the holder device 3.

The foregoing yaw axis refers to a rotation axis of the link root junction portion 20, and extends in a vertical direction. Besides, the foregoing pitch axes each refer to a rotation axis about which a corresponding one of the first and second links 21 and 22 is rotated or pivoted upward or downward. The roll axis refers to a rotation axis about which the attachment portion 23 and the holder device 3 are rotated relative to the second link 22, and corresponds to an axis line the second link 22.

The base portion 11*a* of the carriage body 11 is provided with a first motor (first drive portion) 61 that rotationally drives the link root junction portion 20 about the yaw axis. Besides, the first joint portion 51 linking the link root junction portion 20 and the first link 21 is provided with a second motor (second drive portion) 62 that rotationally drives the first link 21 about the pitch axis. The rotation power of the second motor 62 is transmitted to the first link 21 via a first timing belt 81.

The second joint portion 52 linking the first link 21 and the second link 22 is provided with a third motor (third drive portion) 63 that rotationally drives the second link 22 about the pitch axis. The rotating drive force of the third motor 63 is transmitted to the second link 22 via a second timing belt 82. Then, the third joint portion 53 linking the second link 22 and the attachment portion 23 is provided with a fourth motor (fourth drive portion) 64 that rotationally drives the attachment portion 23 and the holder device 3 about the roll axis.

Incidentally, the aforementioned power transmission means is not limited to a timing belt. Instead, the power transmission means may also be, for example, a gear. Since motors are relatively large-mass component elements, the advantage in terms of reducing the moment of a link is greater the closer to the support point of the link a motor is disposed. Therefore, this embodiment adopts a driving method in which the joint portion is not directly driven by a motor, but is indirectly driven via power transmission means. However, it is also permissible to directly drive a joint shaft without using a power transmission mechanism.

The attachment portion 23 of the robot arm portion 2 is provided with a manipulation handle 24 provided for the care giver to use in operating the transfer assist apparatus 10. The manipulation handle 24 is equipped with a force sensor via which the manipulation handle 24 is linked to the attachment portion 23 of the robot arm portion 2. Due to the force sensor, it is possible to detect manipulation signals that are commensurate with the magnitude of manipulation force given to the manipulation handle 24, the direction of the force, the moment, etc. The force sensor outputs the detected manipulation signals to a control device 17 as described below.

The holder device (first holder device) 3 is attached to the attachment portion 23 of the robot arm portion 2. The holder device 3 has a trunk support portion 31 that holds a care recipient by the care recipient's trunk, and a leg support portion 32 that supports leg portions of the care recipient. The leg support portion 32 is formed generally in an inverted T shape, and is connected to a lower portion of the trunk support portion 31. Incidentally, although the trunk support portion 31 and the leg support portion 32 are integrally constructed in this example, the two portions may also be constructed separately from each other.

Figure 3:
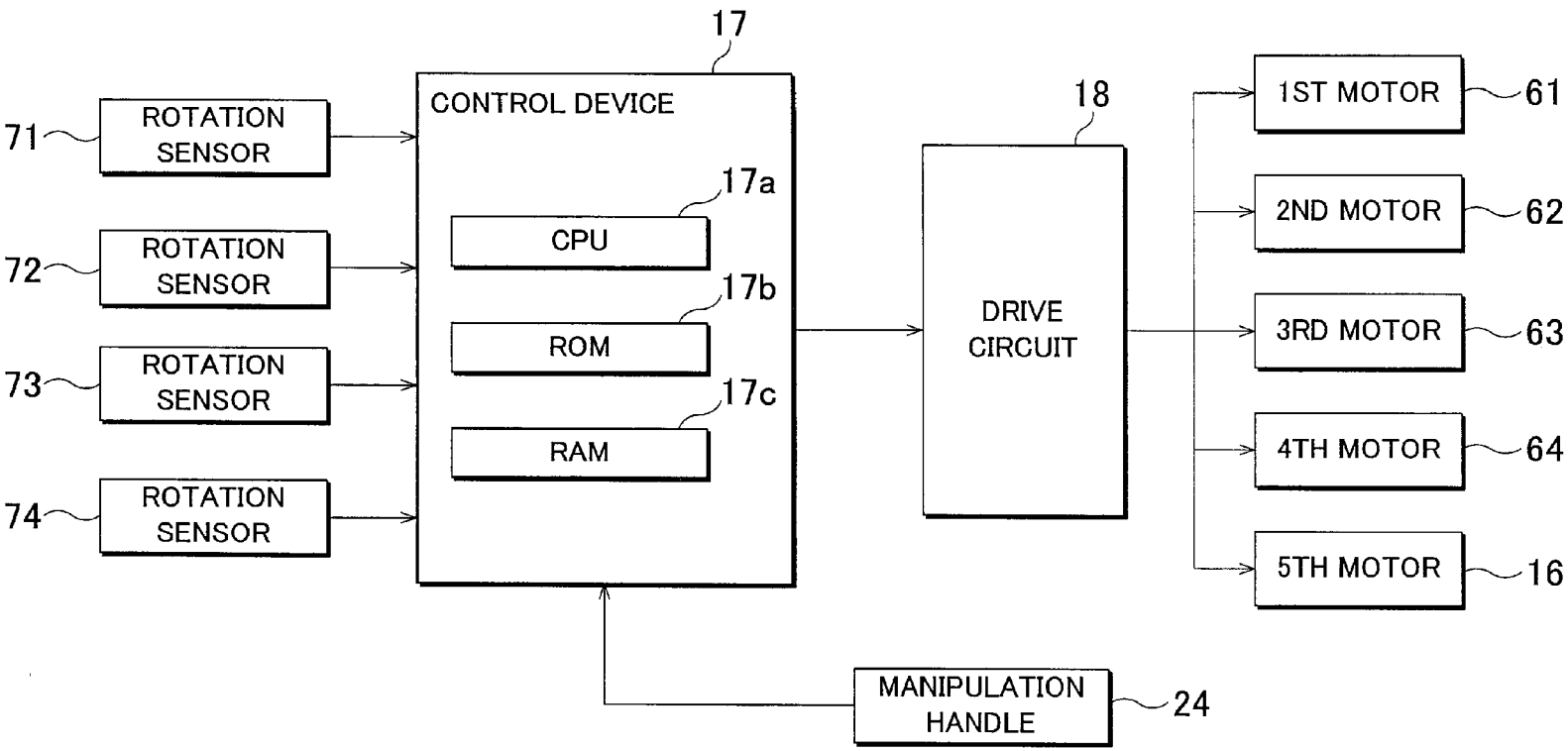
FIG. 3 is a block diagram showing a system construction of the transfer assist apparatus in accordance with Embodiment 1.

FIG. 3 is a block diagram showing an example of a system construction of the transfer assist apparatus in accordance with Embodiment 1 of the invention. The carriage portion 1 is provided with the control device 17 that controls the rotational driving of the first to fifth motors 61, 62, 63, 64 and 16. The control device 17 is constructed of a microcomputer as a central portion which has a CPU (central processing unit) 17*a* that performs control processes, computation processes, etc., a ROM (read-only memory) 17*b* that stores control programs, computation programs that are executed by the CPU 17*a*, and a RAM (random access memory) 17*c* provided for temporarily storing process data, and the like.

The first to fifth motors 61, 62, 63, 64 and 16 are connected to the control device 17 via a drive circuit 18, and perform the rotational driving on the basis of the control signals from the control device 17. Besides, the base portion 11*a* and the first to third joint portions 51, 52 and 53 are provided with rotation sensors 71, 72, 73 and 74, such as potentiometers or the like, which detect the amounts of rotational driving of the first to fourth motors 61, 62, 63 and 64, respectively. The rotation sensors 71, 72, 73 and 74 are connected to the control device 17, and output the detected amounts of driving rotation to the control device 17.

As shown in FIG. 3, the control device 17 feedback-controls the first to fourth motors 61, 62, 63 and 64 on the basis of an manipulation signal from the force sensor of the manipulation handle 24, and the amounts of rotational driving from the rotation sensors 71, 72, 73 and 74. Therefore, the care giver can easily and accurately move the robot arm portion 2 of the transfer assist apparatus 10 to a desired position.

Incidentally, although in the manipulation handle 24 is attached to the attachment portion 23 of the robot arm portion 2 in the foregoing example, this is not restrictive. The manipulation handle 24 may also be attached to, for example, the handle portion 12 of the carriage portion 1, and can be attached to any position as long as the manipulation handle is operable by the care giver.

Figure 4:
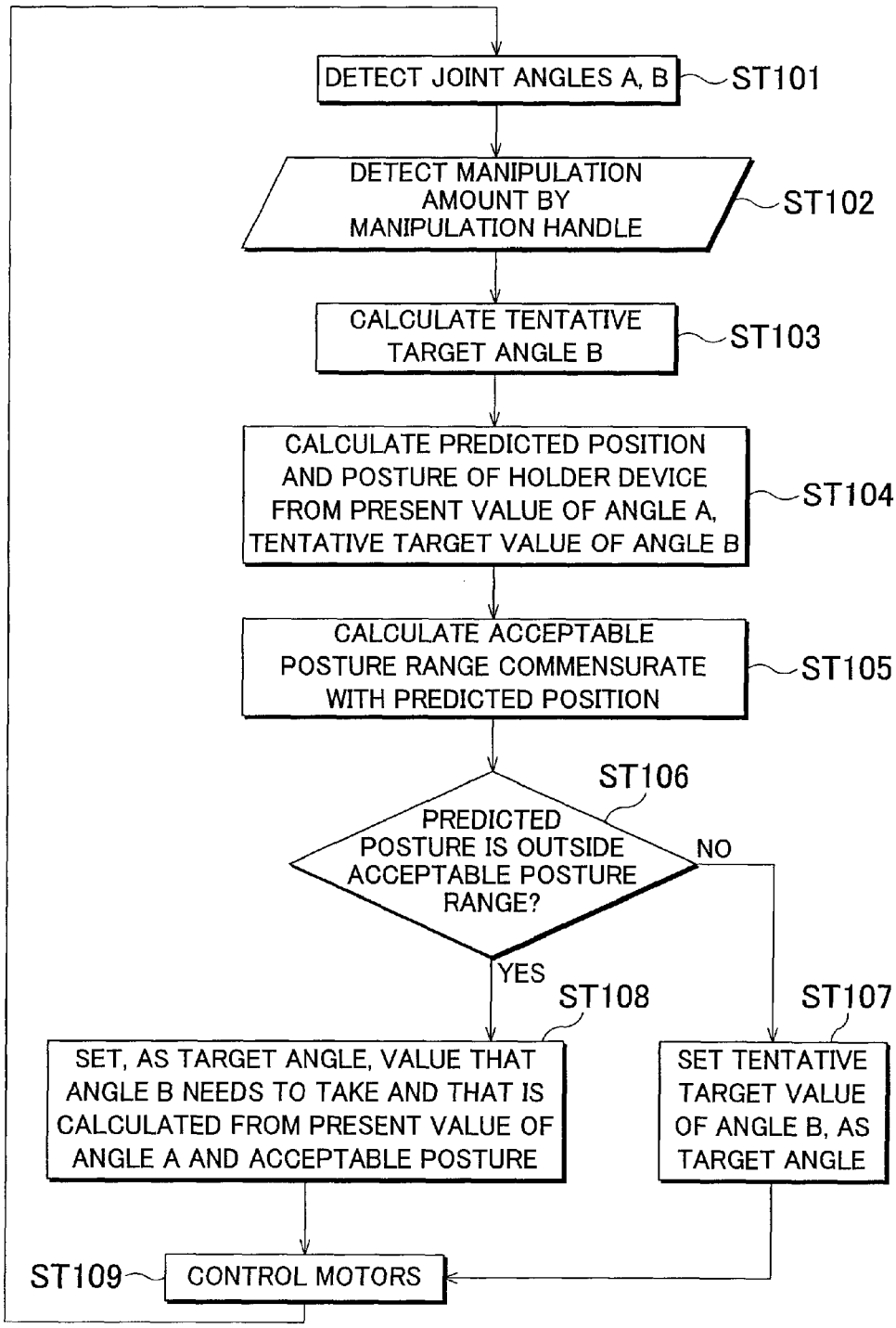
FIG. 4 is a flowchart showing a posture control method for a holder device in accordance with Embodiment 1.

Next, a method of controlling the posture of the holder device 3 in accordance with Embodiment 1 will be described with reference to FIG. 4. FIG. 4 is a flowchart showing the posture control method for the holder device 3 in accordance with Embodiment 1. In order to transfer a care recipient safely without hurting the care recipient, the holder device 3 needs to be kept in an appropriate posture. In this embodiment, the posture of the holder device 3 is determined by the first joint portion 51 and the second joint portion 52. That is, the degree of freedom in the posture is two. If the degree of freedom is 2 or higher, the embodiment can be applied. In this embodiment, the second joint portion 52 is manipulated.

Firstly, the joint angle A of the first joint portion 51, and the joint angle B of the second joint portion 52 are detected by the corresponding rotation sensors 71 and 72 (ST101). Next, the amount of manipulation is detected by the force sensor of the manipulation handle 24 (ST102). Next, a tentative target value of the joint angle B is calculated on the basis of the detected amount of manipulation (ST103).

Next, a predicted position and a predicted posture of the holder device 3 are calculated from the present value of the joint angle A detected in step ST101, and the tentative target angle value of the joint angle B calculated in step ST103 (ST104).

Next, postures of the holder device 3 that are acceptable to the care recipient, that is, an acceptable posture range, is found (ST105). Data that shows the correspondence between the predicted position and the acceptable posture range is stored in the ROM 17*b*.

Next, it is determined whether or not the predicted posture calculated in step ST104 is outside the acceptable posture range found in step ST105 (ST106). If the predicted posture is not outside the range (NO in ST106), the tentative target angle value of the joint angle B is set as a target angle (ST107), and the motors are accordingly controlled (ST109).

On the other hand, if the predicted posture is outside the acceptable range (YES in ST106), the target angle value of the joint angle B is set to the angle value that the joint angle B needs to take on the basis of the present value of the joint angle A detected in step ST101, and the acceptable posture found in step ST105 (ST108). Then, the motors are accordingly controlled (ST109). The process of steps ST101 to ST109 is repeatedly executed. Thus, the posture of the holder device can be quickly and accurately controlled by restricting the angle of the joint that is being manipulated (the second joint portion 52 in this embodiment) according to the angle of the joint that is not being manipulated (the first joint portion 51 in this embodiment).

Figure 5:
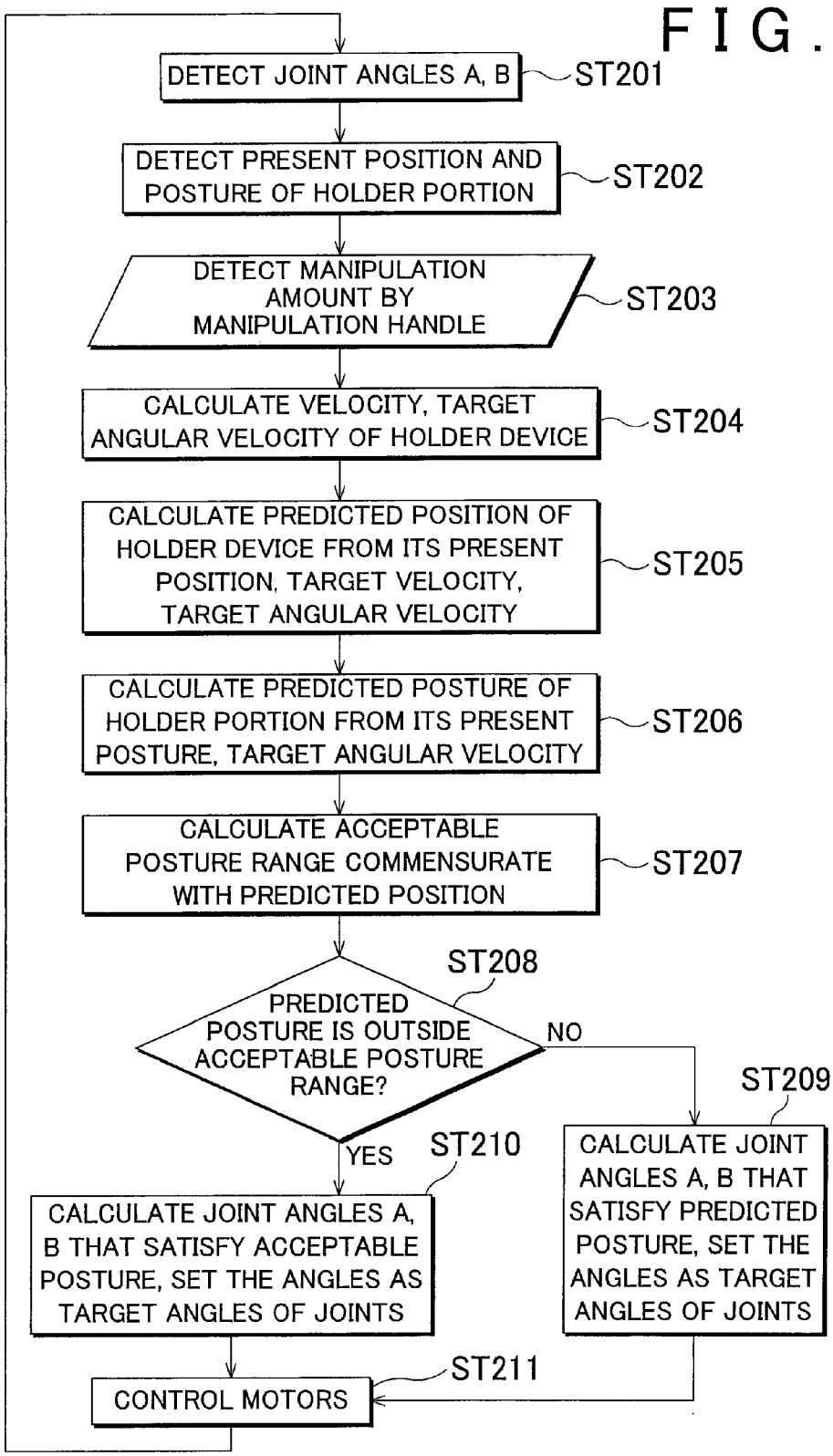
FIG. 5 is a flowchart showing a posture control method for the holder device in accordance with Embodiment 2.

Next, Embodiment 2 of the invention will be described. A difference thereof from Embodiment 1 is the procedure of the posture control method for the holder device 3. Other constructions and the like of Embodiment 2 are substantially the same as those of Embodiment 1, and descriptions thereof are omitted below. With reference to FIG. 5, a posture control method for the holder device 3 in accordance with this embodiment will be described. In this embodiment, the first joint portion 51 and the second joint portion 52 are manipulated.

Firstly, the joint angle A of the first joint portion 51 and the joint angle B of the second joint portion 52 are detected by the corresponding rotation sensors 71 and 72 (ST201). Next, the present position and the present posture of the holder device 3 are calculated from the joint angle A and the joint angle B detected in step ST201 (ST202). Next, the amount of manipulation is detected by the force sensor of the manipulation handle 24 (ST203). Next, a target velocity and a target angular velocity at which the posture of the holder device 3 is to be changed are calculated (ST204) on the basis of the amount of manipulation.

Next, a predicted position of the holder device 3 is calculated from the present position of the holder device 3 calculated in step ST202, and the target velocity and the target angular velocity calculated in step ST204 (ST205).

Next, a predicted posture of the holder device 3 is calculated from the present posture of the holder device 3 calculated in step ST202, and the target angular velocity calculated in step ST204 (ST206). Next, the postures of the holder device 3 that are acceptable to the care recipient, that is, an acceptable posture range, is found according to the predicted position of the holder device 3 calculated in step ST205 (ST207). Data that shows the correspondence between the predicted position and the acceptable posture range is stored in the ROM 17*b*.

Next, it is determined whether or not the predicted posture calculated in step ST206 is outside the acceptable posture range found in step ST207 (ST208). If the predicted posture is not outside the acceptable range (NO in ST208), a joint angle A and a joint angle B that satisfy the predicted posture are calculated, and the calculate joint angles are set as target angles of the two joints (ST209). Then, the motors are controlled (ST211).

On the other hand, if the predicted posture is outside the acceptable range (YES in ST208), a joint angle A and a joint angle B that satisfy the acceptable posture range are calculated, and the calculated joint angles are set as target angles of the two joints (ST209). Then, the motors are controlled (ST211). The process of steps ST201 to ST211 is repeatedly executed. Thus, the posture of the holder device can be quickly and accurately controlled by restricting the target posture and determining the angles of the joints that are being manipulated (the first joint portion 51 and the second joint portion 52 in this embodiment).

Figure 6:
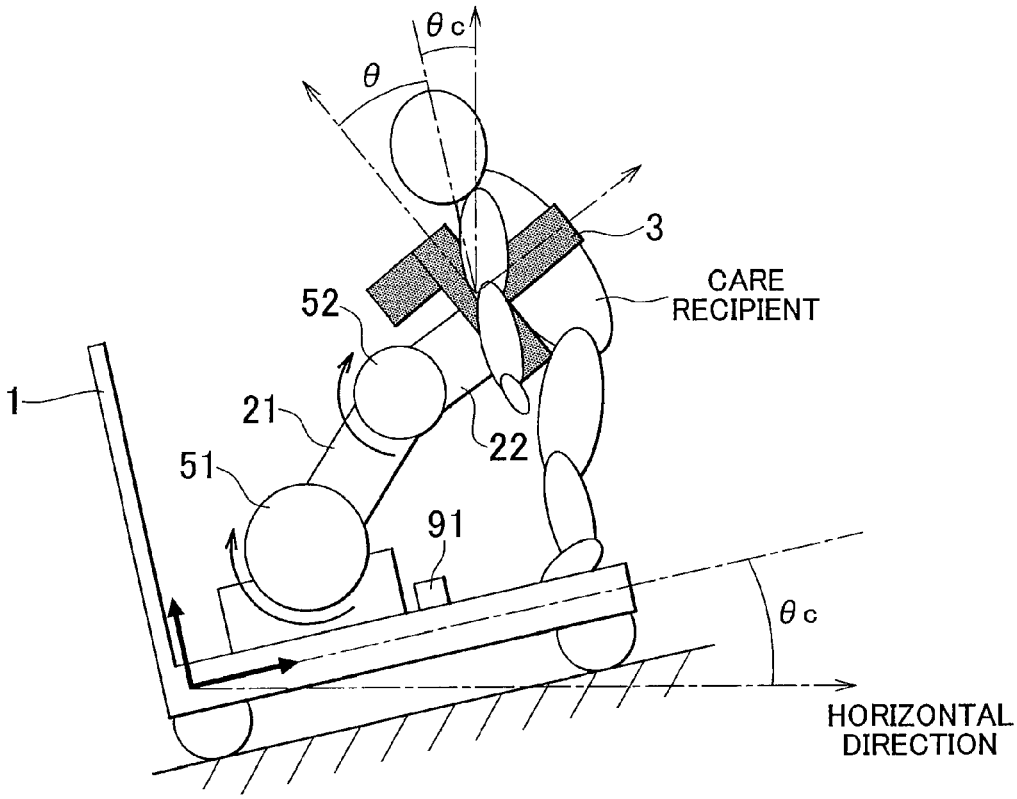
FIG. 6 is a diagram for illustration of Embodiment 3.

Next, Embodiment 3 of the invention will be described. FIG. 6 is a diagram showing a case where the transfer assist apparatus 10 in Embodiment 1 and 2 is operated on a slope. For example, if a clinometer 91 is mounted on the carriage 1, the inclination angle θc of a slope can also be detected by the clinometer 91. Specifically, in step ST101 or ST201 in Embodiment 1 or 2, the inclination angle θc of the slope can be detected in addition to the joint angle A and the joint angle B.

In Embodiments 1 and 2 in which the inclination angle θc is not taken into account, the posture of the holder device 3 can be defined by, for example, the angle θ formed between the direction of a normal to a main surface of the carriage body 11 and a main surface of the trunk support portion 31 of the holder device 3 as shown in FIG. 6. The angle value θ is determined by the joint angle A and the joint angle B.

However, in this embodiment, the posture θh of the holder device 3 is defined as θh=θ+θc since a surface on which the transfer assist apparatus 10 is disposed is inclined by an angle θc from the horizontal direction. Thus, even in the case where the transfer assist apparatus 10 is placed and operated on a slope, the posture of the holder device 3 can be quickly and accurately controlled so as not to hurt the care recipient.

Figure 7:
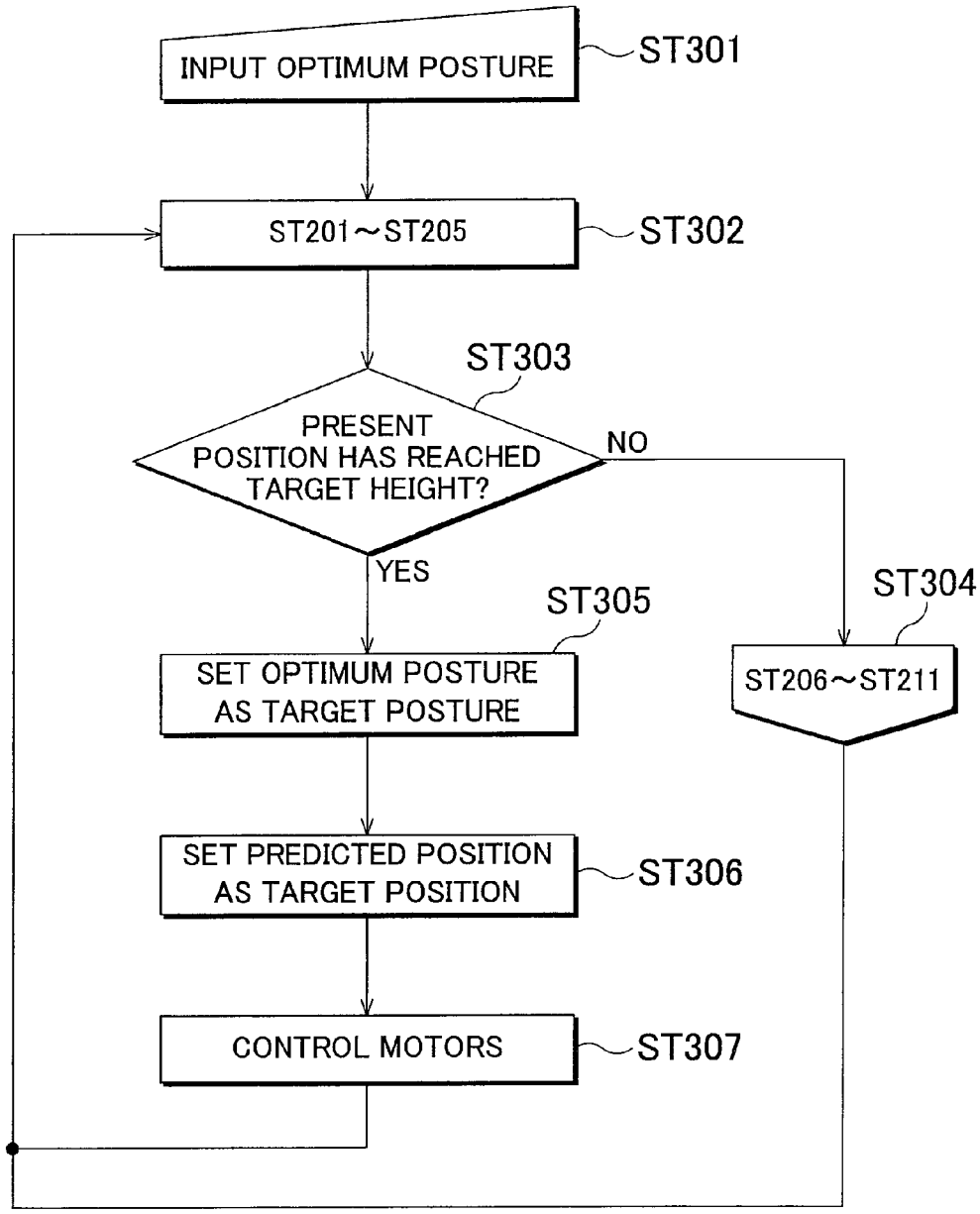
FIG. 7 is a flowchart showing a posture control method for the holder device in accordance with Embodiment 4.

Next, Embodiment 4 of the invention will be described. FIG. 7 is a flowchart showing a posture control method for the holder device 3 in accordance with this embodiment. In this embodiment, a predetermined flow of process is added to the flow of process executed in Embodiment 2. With reference to FIG. 7, a posture control method for the holder device 3 in accordance with this embodiment will be described.

Firstly, an optimum posture of the holder device 3 is input to the control device 17 (ST301). Next, the process of step ST201 to ST205 in Embodiment 2 shown in FIG. 5 is executed (ST302). Next, it is determined whether or not the present position of the holder device 3 has reached a target height (ST303).

If the present position has not reached the target height (NO in ST303), the process of steps ST201 to ST205 in Embodiment 2 shown in FIG. 5 is executed. After that, the process returns to step ST302, in which the process of steps ST206 to ST211 in Embodiment 2 shown in FIG. 5 is executed. That is, while the target height is not reached, the process of steps ST201 to ST211 in Embodiment 2 is repeatedly executed.

If the target height has been reached (YES in ST303), the optimum posture input in step ST301 is set as a target posture (ST305). Next, the predicted position of the holder device 3 calculated in step ST205 in the process of ST302 is set as a target position (ST306). Then, the motors are controlled (ST307).

Thus, while the holder device 3 has reached a predetermined height, the posture of the holder device 3 can be kept to be the optimum posture. A result of a questionnaire shows that many care recipients demand that the posture of the holder device 3 be maintained while they are lifted. This embodiment is to meet this demand of care recipients. On the other hand, in the case where a care recipient is to be lifted from a bed or the like, or in the case where a care recipient is to be lowered onto a wheelchair or the like, it is necessary that the care recipient be in a posture that is different from the care recipient's posture taken while the care recipient is being carried after being lifted. In such a case, this embodiment is suitable.

Incidentally, in this embodiment, the target height does not need to be a constant value that is determined beforehand. Besides, the target height may also be estimated from the standing height of a care recipient, the sitting height thereof, etc.

Features of the foregoing embodiments of the invention will be summarized below.

In the transfer assist apparatus, the acceptable range of posture may be calculated on the basis of the information that is input from the manipulation handle.

The transfer assist apparatus may further include a clinometer for measuring the inclination angle of a plane on which the transfer assist apparatus is disposed, and the posture of the holder portion may also be controlled on the basis of the inclination angle.

In the transfer assist apparatus, the control portion may also maintain the posture of the holder portion while the position of the holder portion is above a predetermined height.

Besides, in the transfer assist apparatus, the control portion may determine the angles of the first and second joints from the acceptable range, and may automatically control the first drive mechanism and the second drive mechanism.

In the control method for the transfer assist apparatus, the predetermined acceptable range may be calculated on the basis of the information that is input from the manipulation handle.

In the control method for the transfer assist apparatus, the posture of the holder portion may also be controlled on the basis of the inclination angle of a plane on which the transfer assist apparatus is disposed.

In the control method for the transfer assist apparatus, a control may be performed such as to keep the posture of the holder portion while the position of the holder portion is above a predetermined height.

In the control method for the transfer assist apparatus, the angles of the first joint and the second joint are determined from the predetermined acceptable range, and the first drive mechanism and the second drive mechanism may be automatically controlled.

While the invention has been described with reference to example embodiments thereof, it is to be understood that the invention is not limited to the described embodiments or constructions. On the other hand, the invention is intended to cover various modifications and equivalent arrangements. In addition, while the various elements of the disclosed invention are shown in various example combinations and configurations, other combinations and configurations, including more, less or only a single element, are also within the scope of the appended claims.

What is claimed is:

1. A transfer assist apparatus comprising:

an arm portion that has a first joint and a second joint;

a holder portion linked to the arm portion;

a manipulation handle for manipulating position of the holder portion;

a first drive mechanism that rotationally drives the first joint;

a second drive mechanism that rotationally drives the second joint, wherein a rotation axis about which the first joint is rotated is parallel to a rotation axis about which the second joint is rotated, and wherein the position and posture of the holder portion is determined by an angle of the first joint and an angle of the second joint;

a memory that stores data showing a correspondence between a predicted position of the holder portion, which is calculated based on information that is input from the manipulation handle, and an acceptable posture range at the predicted position; and a control portion that receives angle measurements from at least one rotation sensor and that is programmed to determine a target angle of the first joint and a target angle of the second joint so as to satisfy the acceptable posture range if a predicted posture of the holder portion at the predicted position is outside the acceptable posture range, wherein the control unit is further programmed to control the first drive mechanism and the second drive mechanism so that the angle of the first joint matches the target angle of the first joint and the angle of the second joint matches the target angle of the second joint, wherein the control portion performs a control so as to hold the posture of the holder portion while the position of the holder portion is above a predetermined height, and wherein a tentative target value of the joint angle of the second joint which is being manipulated by the manipulation handle is calculated on the basis of the amount of manipulation, and a target value of the joint angle of the first joint which is not being manipulated is automatically determined to maintain the posture of the holder portion in the predetermined acceptable range.

2. The transfer assist apparatus according to claim 1, further comprising a clinometer for measuring an inclination angle of a plane on which the transfer assist apparatus is disposed, wherein the control portion controls the posture of the holder portion based on the inclination angle.

3. The transfer assist apparatus according to claim 1, wherein the control portion automatically controls the first drive mechanism and the second drive mechanism so that the angle of the first joint matches the target angle of the first joint and the angle of the second joint matches the target angle of the second joint.

4. The transfer assist apparatus according to claim 1, wherein the holder portion holds a care recipient.

5. The transfer assist apparatus according to claim 1, wherein the holder portion includes a trunk support portion that supports a trunk of a care recipient, and a leg support portion that supports a leg portion of the care recipient.

6. The transfer assist apparatus according to claim 1, wherein the control portion receives magnitude of manipulation force on the handle, direction of the manipulation force, moment, as the information input from the manipulation handle.

7. A control method for a transfer assist apparatus that includes an arm portion that has a first joint and a second joint, a holder portion linked to the arm portion, a manipulation handle for manipulating position and posture of the holder portion, a first drive mechanism that rotationally drives the first joint, a second drive mechanism that rotationally drives the second joint, said control method comprising:

detecting angle information regarding the first joint and the second joint by rotation sensors;

detecting information that is input from the manipulation handle;

calculating a predicted position of the holder portion based on information that is input from the manipulation handle;

using memory that stores data showing a correspondence between the predicted position and an acceptable posture range at the predicted position to determine whether a predicted posture of the holder portion at the predicted position is outside the acceptable posture range;

determining a target angle of the first joint and a target angle of the second joint by a control unit so as to satisfy the acceptable posture range if the predicted posture of the holder portion at the predicted position is outside the acceptable posture range; and controlling the first drive mechanism and the second drive mechanism by the control unit so that an angle of the first joint matches the target angle of the first joint and an angle of the second joint matches the target angle of the second joint, performing a control so as to hold the posture of the holder portion while the position of the holder portion is above a predetermined height, wherein a rotation axis about which the first joint is rotated is parallel to a rotation axis about which the second joint is rotated and wherein the position and posture of the holder portion is determined by the angle of the first joint and the angle of the second joint, and wherein a tentative target value of the joint angle of the second joint which is being manipulated by the manipulation handle is calculated on the basis of the amount of manipulation, and a target value of the joint angle A of the first joint which is not being manipulated is automatically determined to maintain the posture of the holder portion in the predetermined acceptable range.

8. The control method according to claim 7, further comprising controlling the posture of the holder portion based on an inclination angle of a plane on which the transfer assist apparatus is placed.

9. The control method according to claim 7, wherein the first drive mechanism and the second drive mechanism are automatically controlled so that the angle of the first joint matches the target angle of the first joint and the angle of the second joint matches the target angle of the second joint.

10. The control method according to claim 7, further comprising receiving magnitude of manipulation force on the manipulation handle, direction of the manipulation force, and moment, as the information input from the manipulation handle.

* * * * *